US007112102B2

(12) United States Patent
Masaki et al.

(10) Patent No.: US 7,112,102 B2
(45) Date of Patent: Sep. 26, 2006

(54) BASE CONNECTOR

(75) Inventors: Katsuyuki Masaki, Kanagawa (JP); Shinichi Kodama, Kanagawa (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/261,716

(22) Filed: Oct. 31, 2005

(65) Prior Publication Data

US 2006/0094306 A1 May 4, 2006

(30) Foreign Application Priority Data

Nov. 1, 2004 (JP) ..... 2004-317952

(51) Int. Cl.
*H01R 33/00* (2006.01)
*H01R 13/10* (2006.01)

(52) U.S. Cl. ..... 439/682; 439/660

(58) Field of Classification Search ..... 439/682, 439/857, 850

See application file for complete search history.

(56) References Cited

U.S. PATENT DOCUMENTS

| | | | | |
|---|---|---|---|---|
| 5,788,539 | A * | 8/1998 | Fedder | 439/682 |
| 5,951,331 | A * | 9/1999 | Li-Ming et al. | 439/682 |
| 6,039,610 | A * | 3/2000 | Pauza et al. | 439/682 |
| 6,506,081 | B1 * | 1/2003 | Blanchfield et al. | 439/682 |
| 6,551,143 | B1 * | 4/2003 | Tanaka et al. | 439/682 |
| 6,848,950 | B1 * | 2/2005 | Allison et al. | 439/682 |
| 2001/0021609 | A1 * | 9/2001 | Chiang | 439/682 |
| 2004/0002265 | A1 * | 1/2004 | Shimizu et al. | 439/660 |
| 2005/0186855 | A1 * | 8/2005 | Shimizu et al. | 439/682 |

FOREIGN PATENT DOCUMENTS

| | | | |
|---|---|---|---|
| JP | H08-055657 | A | 2/1996 |
| JP | H08-213082 | A | 8/1996 |
| JP | H08-306422 | A | 11/1996 |
| JP | H10-097878 | A | 4/1998 |
| JP | 2001-085088 | A | 3/2001 |
| JP | 2001-527687 | A | 12/2001 |
| JP | 2002-033150 | A | 1/2002 |
| WO | WO-098/02942 | A | 1/1998 |

* cited by examiner

*Primary Examiner*—Tulsidas C. Patel
*Assistant Examiner*—Vladimir Imas
(74) *Attorney, Agent, or Firm*—Rader, Fishman & Grauer PLLC

(57) ABSTRACT

A connector which has a structure appropriate for height-lowering is provided. The connector has a concave part 11 formed from a pair of opposing side walls 12*a* and 12*b*, and a back wall 12*c* which is orthogonal to this pair of opposing side walls 12*a* and 12*b*, and the rectangular plate bottom board. The blade contact 3 according to the present invention is configured such that it is inserted towards and engaged with the concave part 11 from the back wall 12*c*, and the contact connection part 31 for connecting to the opposing contact is in contact with the bottom surface of the concave part. Therefore, the position of the blade contact can be maintained by the bottom surface of the concave part 11 and the back wall 12*c* more firmly and easier. Thus, the thickness of the base 12 can be made thin and further lowering of the base connector can be realized.

6 Claims, 8 Drawing Sheets

23a
22a 2
23a
24a
24b
22c
23b
PUSH
26a
26b 23b
22b 26a
26b 25a
25b

BASE CONNECTOR

FIELD OF THE INVENTION

The present invention relates to a base connector. More particularly, the present invention relates to a blade contact, for use for an opposing contact including a pair of elastic contact pieces which extend in parallel. A contact force is applied to both surfaces of a planar or folding-knife-shaped the blade contact by this pair of contact pieces. This blade contact is pressed into a base housing and, for example, is solder bonded to a printed circuit board.

RELATED ART

Batteries are embedded into modern, miniaturized mobile electronic devices such as, for example, DSC (Digital Still Camera), mobile telephones, CD players, MD players and the like. In order to feed power supply from this battery to a circuit board (printed circuit board) provided within the electronic device, an infinitesimal, so-called chip-sized package-type, wire-to-board connector is employed.

As the foregoing connector and socket connector, a connector is invented which solves the problem of being easily broken. That is, the opposing connector is attached to the end of a lead wire extending from the battery, the base connector is fixed to the printed circuit board. When the lead wire is pulled for removing the opposing connector from the base connector, both connectors entangle because the insertion/removal directions and the direction in which the lead wire is extended are different (for example, refer to Patent Reference 1).

More particularly, in the connector according to Patent Reference 1, when the lead wire is pulled, this pulling force is converted into a force that follows in the direction the opposing connector is pulled and removed, by the actions of the cam surfaces of the base connector and the opposing connector. In addition, in this connector in reference 1, the opposing contact applies contact force such that the blade contact is embraced from both sides by a pair of contact pieces.

[Patent Reference 1] Japanese Patent Laid-Open Publication No. 2002-33150.

FIG. 12 is a longitudinal sectional view of both connectors in a connected state, according to the prior art of Patent Reference 1. In FIG. 12, hatchings on cross-sections of the opposing contact and blade contact are omitted. Additionally, FIG. 12 in the present application corresponds to FIG. 9 in Patent Reference 1. FIG. 13 is a front view of the socket contact according to Patent Reference 1. FIG. 13 in the present application corresponds to FIG. 8 in Patent Reference 1.

In FIG. 12, connector 100 comprises a base connector 6 and an opposing connector 7. The base connector 6 is solder bonded onto a mounting surface 51 of a printed circuit board 5. On the other hand, the opposing connector 7 is coupled with the base connector 6 and inserted into/removed from a concave part (inserting/removing space) formed in the base connector 6. In FIG. 12, the housing 60 of base connector 6 is provided with a blade contact 8. On the other hand, the housing 70 of opposing connector 7 is provided with a socket contact 9. For example, tripolar blade contacts 8 are aligned in parallel within housing 60, and the corresponding three socket contacts 9 are aligned in parallel within housing 70. Lead wire 9*w*, which is crimped to crimp part 92 of socket contact 9, extends from housing 70.

In FIG. 12, blade contact 8 is held by a base 62 and a back wall 63*c*, inserted into a fixing hole 69 formed in base 62. Blade contact 8 includes a roughly rectangular main body 80 and a lead part 81 which extends from the lower end of main body 80 towards the back. The main body 80 has a contact part 82 which protrudes towards the upper part of base 62 and a fixing part 84 which has a pressing protrusion 83 which is pressed into the fixing hole 69. A through hole 85 is formed in the fixing part 84 in correspondence to the pressing protrusion 83. A chamfer part 86 is formed on the upper edge and front edge of the contact part 82, facilitating an easy insertion of socket contact 9.

In FIG. 12, in blade contact 8, main body 80 is pressed into housing 60 and fixed, and the contact part 82 protrudes towards a concave part formed in the base connector 6. On the other hand, a socket contact 9 is inserted into a quadratic prism shaped reception chamber 71 and held. A region in reception chamber 71 which corresponds to a contact part 91 of socket contact 9 is opened facing the concave part.

In FIG. 12, the opposing connector 7 is inserted into the concave part formed in base connector 6 and engaged to a base connector 7. Then, blade contact 8 and socket contact 9 are conductive and connected.

In FIG. 13, socket contact 9 has a pair of mutually opposing contact pieces 91*a* and 91*b* which extends in parallel. Contact points 91*c* and 91*d* which are formed from mutually opposing protrusions protruding towards the opposing faces of the pair of contact pieces 91*a* and 91*b* are provided.

In FIG. 13, contact part 82 (refer to FIG. 12) of blade contact 8 is led into a gap S between a pair of opposing contact points 91*c* and 91*d*. The blade contact 8 is held elastically by the pair of contact pieces 91*a* and 91*b* in an embraced-state, and a contact force is secured between blade contact 8 and socket contact 9.

However, a further reduction in mounting-height is requested of base connector 6, shown in FIG. 12. On the other hand, the mounting-height of base connector 6 is mostly regulated by the height of blade contact 8, provided in base connector 6. This is because, in FIG. 12, blade connector 8 is pressed from the bottom surface of base 62. If base 62 does not have the predetermined thickness, blade contact 8 cannot maintain its position. Further lowering of the base connector by changing the structure of the blade contact is required. This is the object of the present invention.

In view of the foregoing problems, the present invention is to provide a base connector which has a blade contact placed in a concave part formed in the base connector. The object thereof is to provide a blade contact which has a structure adaptable for a use of a base connector suited for height-reduction.

SUMMARY OF THE INVENTION

In order to achieve the foregoing object, the inventors invented a base connector which has a base housing including a concave part formed from a pair of opposing walls, a back wall which is perpendicular to this pair of opposing walls, and a substantially rectangular plate bottom board. A blade contact is inserted from the back wall of the base housing and engaged thereto, and a bottom surface of the contact connection part of the blade contact is in contact with the surface of the concave part.

1. A base connector including: a housing having a rectangular plate bottom board, a back wall, and a pair of opposing side walls which are perpendicular to the bottom board, the back wall and the pair of opposing side walls protruding from three edges of the bottom board; and a blade contact which is an elongated plate extends parallel to the side walls, the blade contact including: a fixing part at an end of the contact, the fixing part in embended in the back wall; and a bottom face in contact with a surface of the rectangular plate bottom board.

In the base connector according to 1, the contact has a housing having a roughly rectangular plate bottom board, a back wall, and a pair of opposing side walls which are perpendicular to the bottom board, the back wall and the pair of opposing walls protruding from three edges of the bottom board. Therefore, a concave part is formed by being surrounded by these three walls and the bottom board. The contact (hereinafter called a blade contact) is an elongated plate, and the blade contacts extend from the back wall as a base end, disposed parallel to the side walls. The blade contact has a rectangular board-shaped contact connection part for connecting to an opposing contact and a fixing part which is provided at the base end of the contact connection part and inserted into and engaged with the back wall. A bottom face of the contact extending in the longitudinal direction of the contact connection part is in contact with the bottom surface of the concave part, which is an internal surface of the bottom board.

The placement of the blade contact to the concave part of the housing, for example, includes the having the contact connection part protruded from the concave part for connecting with the opposing contact. The contact connection parts are aligned on the concave part and engage with the opposing contacts accommodated within the opposing housing, then they are connected.

This base connector, for example, can be a connector for a printed circuit board which is fixed to a printed circuit board, and can include, for example, a type in which the base connector is fixed to a printed circuit board by screws or the like, or the other type in which the blade contact which is pressed and fixed to the base housing is fixed to the printed circuit board by solder bonding, in other words, a surface mounting in which the base connector is fixed to the printed circuit board. In the surface mounting, the base connector can be fixed to the printed circuit board by providing a pair of metallic reinforcement tabs as reinforcement components, pressing and fixing this pair of reinforcement tabs to the base connector, and solder bonding this pair of reinforcement tabs with the blade contact, to the mounting surface of the printed circuit board.

The blade contact is normally defined as contact with a rectangular cross-section, having a chamfered insertion part and no spring-properties (elasticity), and for example, includes an embodiment having a crimp part for crimping lead wire. However, in the present invention, the blade contact may include a contact for a base connector, fixed to the printed circuit board, which is placed within the base connector. In addition, the foregoing "chamfered insertion part" can refer to a region in the contact part.

For example, the opposing contact can be a socket contact provided with a pair of elastic contact pieces which extend in parallel, and the socket contact applies contact force to both surfaces of the contact connection part which is planar or in the shape of folding knife shape. For example, the socket contact can be a so-called tuning fork-type contact, an elastic contact with a tuning fork-shape which is a faston terminal and applies contact force by two arms in the direction of opposing plate. The socket contact can be a Bellows-type two-way contact which is disclosed in prior art, and preferably a socket contact having a structure corresponding to a low-height/miniaturized connector.

In addition, if the connector is for providing battery power, the blade contact and opposing contact can be bipolar or tripolar, or it can be a multi-polar connector having blade contact and opposing contact with more than three poles.

For example, the opposing connector which is connected with the base connector may be a so-called top-type connector. That is, the top-type opposing connector is inserted into and removed from the concave part of the base connector along an insertion/removal direction orthogonal to the mounting surface of the printed circuit board. Moreover, a so-called side-type connector may be employed. In the side-type connector, the connector is inserted into and removed from the base connector along an insertion/removal direction which is parallel to the mounting surface of the printed board, parallel to the side walls. In a wire-to-board connector, the top-type connector is advantageous in that freedom of placement on the printed circuit board is secured. On the contrary, the side-type connector is limited in that the base connector is placed on the end of the printed circuit board.

"The fixing part in embended in the back wall" means that the fixing part is engaged with and inserted to the inside of the back wall. In addition, the concept of "embended in" can include both concepts of "inserted" and "pressed into".

Furthermore, a bottom face of the contact connection part extending in the longitudinal direction is in contact with the bottom surface of the concave part, which is the surface of the rectangular plate bottom board. The other face of the contact connection part extending in the longitudinal direction is chamfered in order to facilitate an easy insertion of the opposing contact.

The blade contact according to this invention is inserted to the housing which has the concave part formed by being surrounded by the pair of opposing side walls, the back wall, and the plate bottom board, from the outside of the housing through an internal wall of the back wall, to the concave part. Furthermore, the bottom face of the contact connection part of the blade contact is attached with the bottom surface of the concave part. Conventionally, a blade contact is pressed into from the bottom surface of the housing so that maintain the position of the blade contact. According to the invention, the position of the blade contact can be maintained by both of the bottom surface of the concave part and the back wall. Thus, the thickness of the housing can be made thin and further lowering of the base connector can be realized.

2. The blade contact according to 1, wherein the fixing part includes a pressing part extending from a contact connection part which is pressed within the back wall, a fixing arm which opposes this pressing part and is inserted into the back wall, and a connecting leg for connecting a base end of the pressing part and the fixing arms together.

In the blade contact according to 2, the fixing part includes a pressing part extending from a contact connection part which is pressed within the back wall, a fixing arm which opposes this pressing part and is inserted into the back wall, and a connecting leg for connecting the base end of the pressing part and the fixing arms together.

For example, the connecting leg may be formed in which the base end of the pressing part pressed into the internal back wall is erected extending parallel to the back wall, furthermore, the fixing arm may be formed reversing from the connecting leg, and this fixing arm may be formed a U-shape which extends to the contact connection part side.

Because the fixing part of the blade contact is configured as above, when the opposing contact is inserted into the contact connection part of the blade contact, a torque of an inserting direction of which a fulcrum is the pressing part, and the contact connection part is connected to the bottom surface of the concave part (refer to FIG. 1). Thus the position of the blade contact is maintained. On the contrary, when the opposing contact is removed from the contact connection part of the blade contact, the torque of a removal direction, of which the fulcrum is the pressing part, is obstructed by the fixing arm, and the position of the blade contact 3 is maintained.

3. The blade contact according to 2, wherein the pressing part includes a pressing protrusion for being engaged within the back wall on the side facing the fixing arm.

For example, the pressing protrusion can be a fine protrusion which protrudes in a mountainous state and can be pressed such as to chumble the back wall which is formed of synthetic resin. In addition, the position of the blade contact is maintained firmly by which mutually opposing fixing arm and pressing part sandwiches the internal back wall.

4. The blade contact according to any one of 1 to 3, wherein the fixing part extends a lead part which is solder bonded to the printed circuit board in the opposite direction of the contact connection part.

As described above, if this base connector is a surface-mounted connector, a lead part is provided in the fixing part, this lead part can be connected to the printed circuit board by solder bonding, a pin terminal which is inserted into a through hole formed in the printed circuit board is provided on the fixing part, and this base connector can be mounted onto the printed circuit board.

The base connector according to the invention has the housing which has the concave part formed by being surrounded by the pair of opposing side walls, the back wall, and the plate bottom board, and the blade contact is inserted from the outside of the housing through an inside of the back wall, to the concave part. Furthermore, the bottom face of the blade contact is attached to the bottom surface of the concave part. Therefore, the position of the blade contact can be maintained by both of the bottom surface of the concave part and the back wall. Thus, the thickness of the housing can be made thin and further lowering of the base connector can be realized.

DESCRIPTION OF THE PREFERRED EMBODIMENTS

Figure 1:
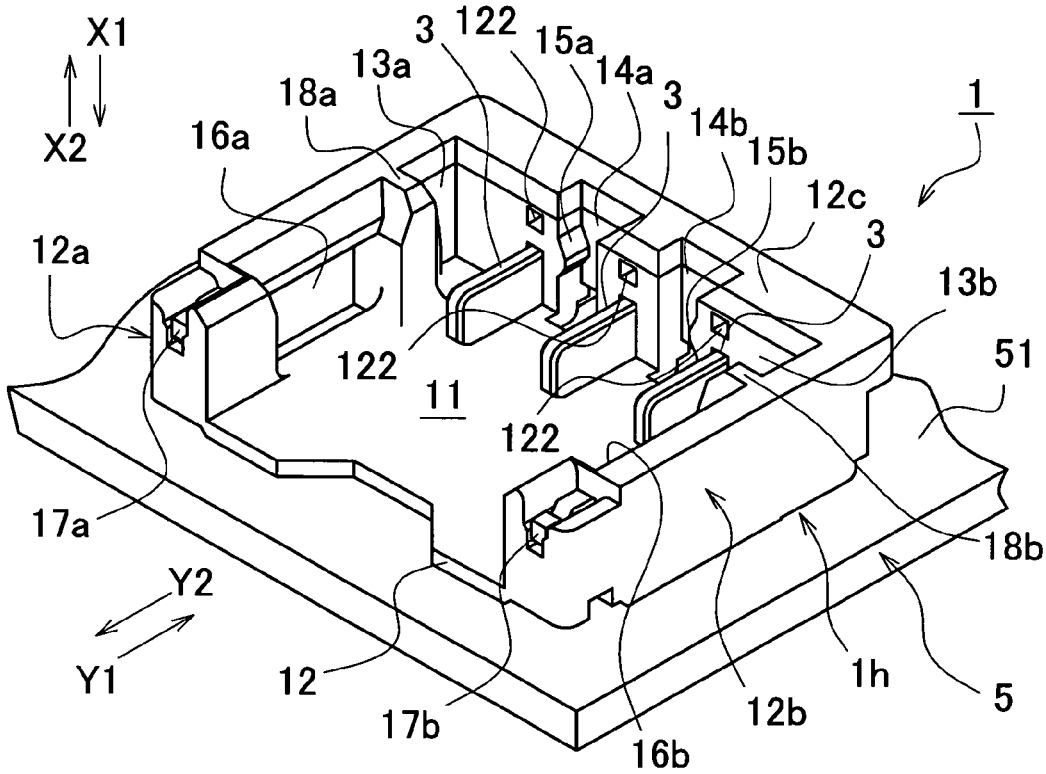
FIG. 1 is a perspective outline view showing a base connector comprising a blade contact in an embodiment according to the present invention.
Figure 2:
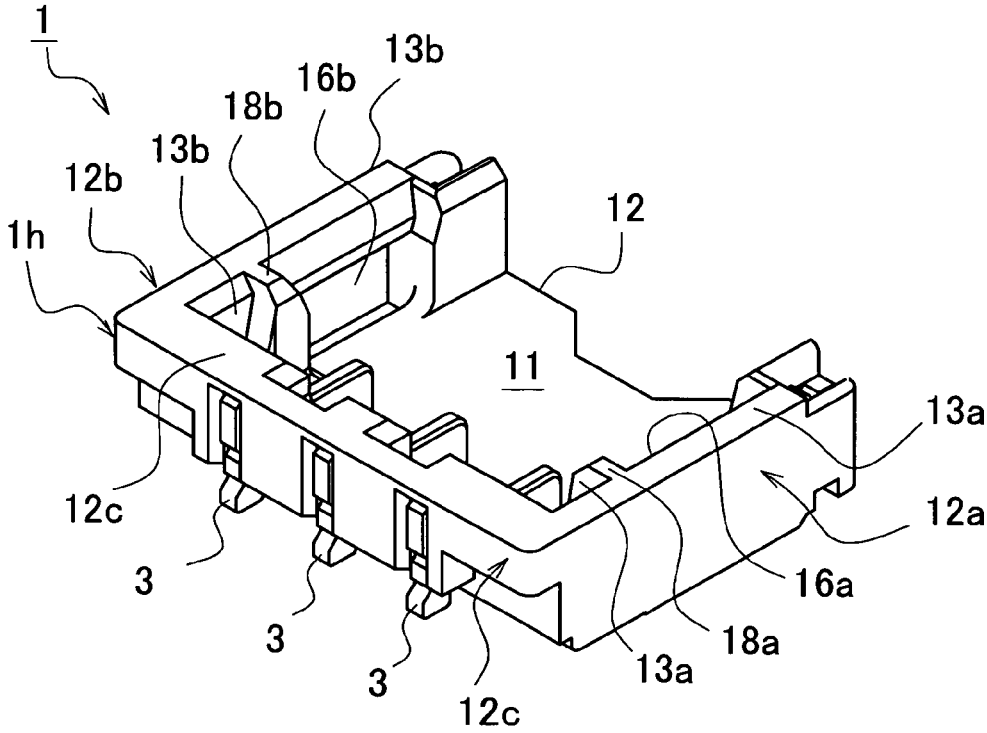
FIG. 2 is a perspective outline view of the base connector according to the embodiment.
Figure 3:
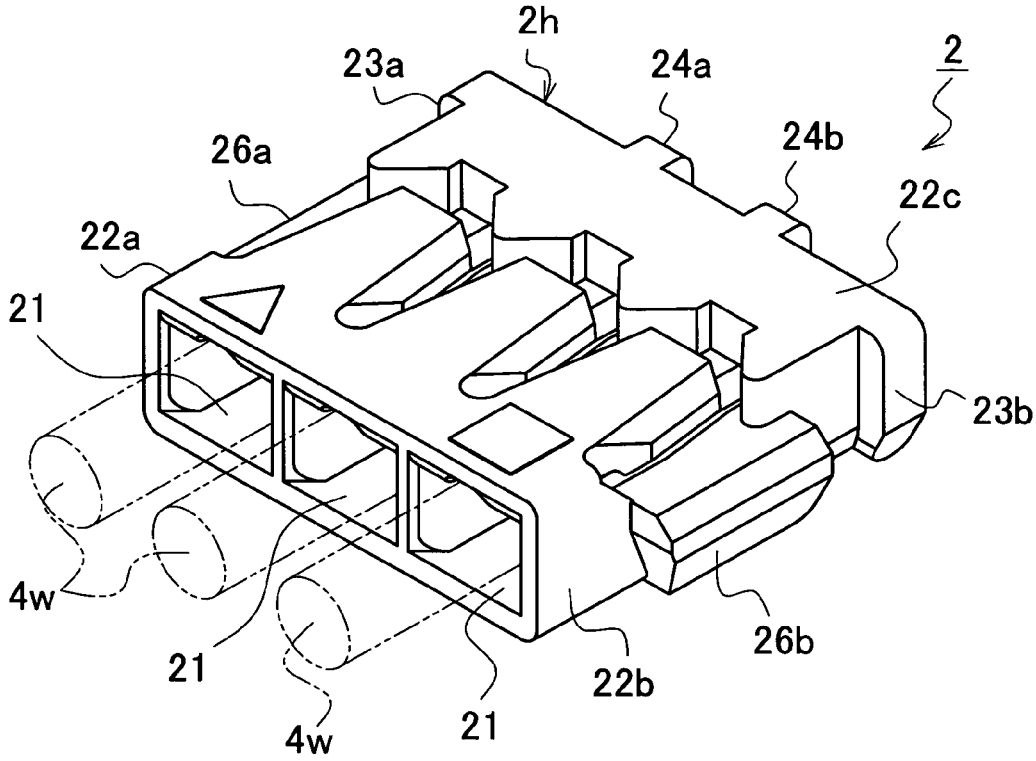
FIG. 3 is a perspective outline view of an opposing connector which is joined with the base connector according to the embodiment.
Figure 4:
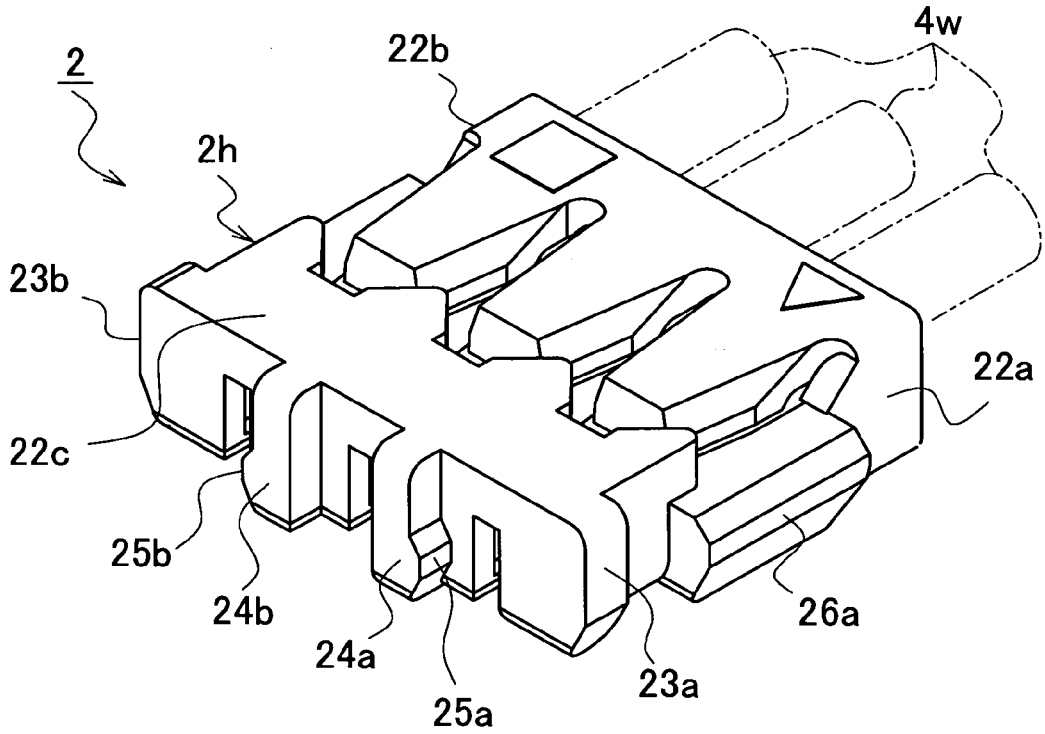
FIG. 4 is a perspective outline view of the opposing connector according to the embodiment.
Figure 5A:
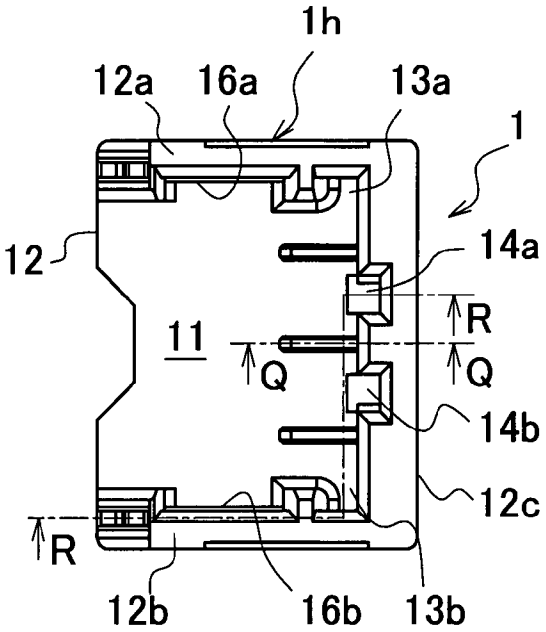
FIG. 5A–FIG. 5F is an outline view and a cross-sectional view of the base connector according to the embodiment.
Figure 5B:
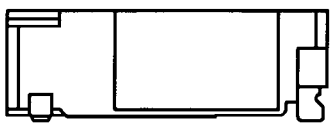
Figure 5C:
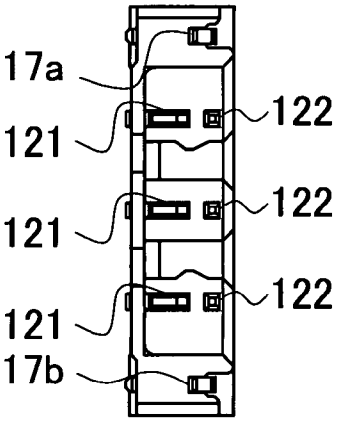
Figure 5D:
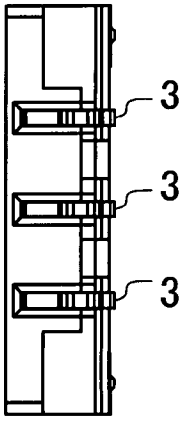
Figure 5E:
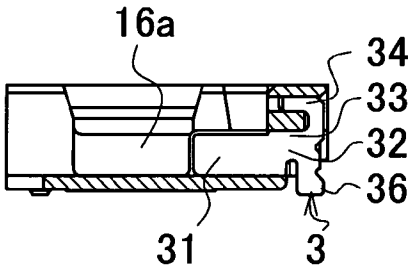
Figure 5F:
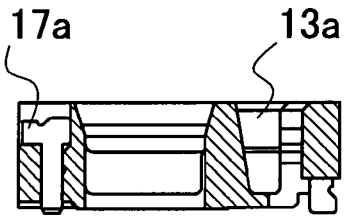

The preferred embodiment of the present invention is described below, with reference to the drawings. FIG. 1 is a perspective outline view showing a base connector including a blade contact in an embodiment according to the present invention. FIG. 2 is a perspective outline view of the base connector according to the embodiment. FIG. 2 shows the base connector seen from the side opposite of that in FIG. 1. FIG. 3 is a perspective outline view of an opposing connector which is joined with the base connector according to the embodiment. FIG. 4 is a perspective outline view of the socket connector according to the embodiment. FIG. 4 shows the opposing connector seen from the side opposite of that in FIG. 4.

Figures 6A, 6B, 6C, 6D, 6E:
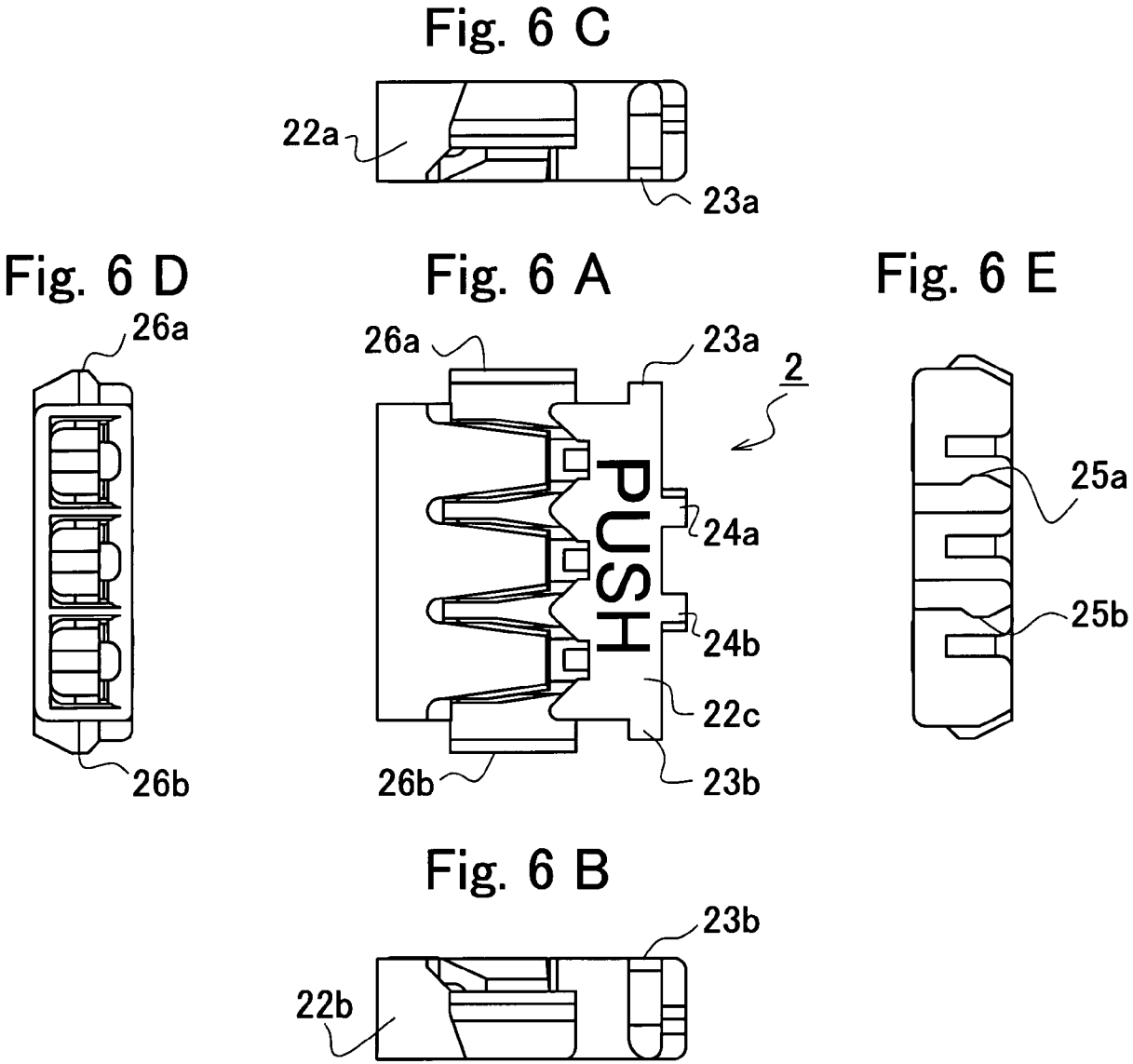
FIG. 6A–FIG. 6E is an outline view of the opposing connector according to the embodiment.

FIG. 5 is an outline view and a cross-sectional view of the base connector according to the embodiment. FIG. 5A is a plan view of the base connector; FIG. 5B is a front view of the base connector; FIG. 5C is a left-side view of FIG. 5A; FIG. 5D is a right-side view of FIG. 5A; FIG. 5E is a cross-sectional view of FIG. 5A, viewed in the direction of arrow Q—Q; and FIG. 5F is a cross-sectional view of FIG. 5A, viewed in the direction of arrow R—R. FIG. 6 is an outline view of the socket connector according to the embodiment. FIG. 6A is a plan view of the opposing connector; FIG. 6B is a front view of the opposing connector; FIG. 6C is a back-side view of the opposing connector; FIG. 6D is a left-side view of FIG. 6A; and FIG. 6E is a right-side view of FIG. 6A.

Figure 7:
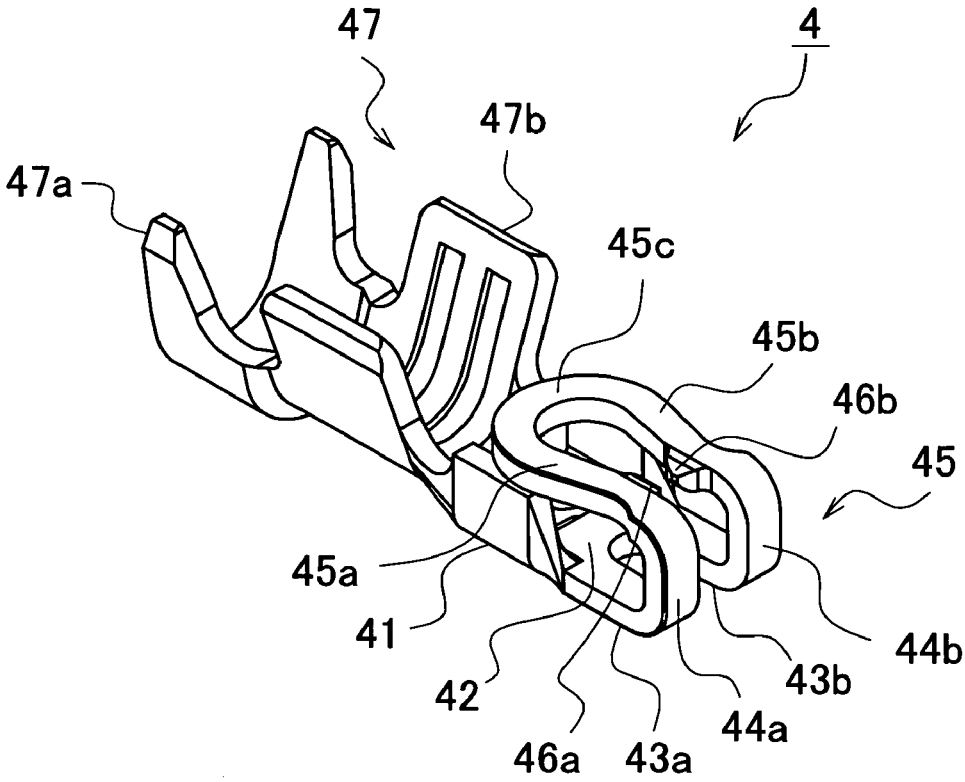
FIG. 7 is a perspective outline view of the opposing contact applied to the socket connector according to the embodiment.
Figure 8:
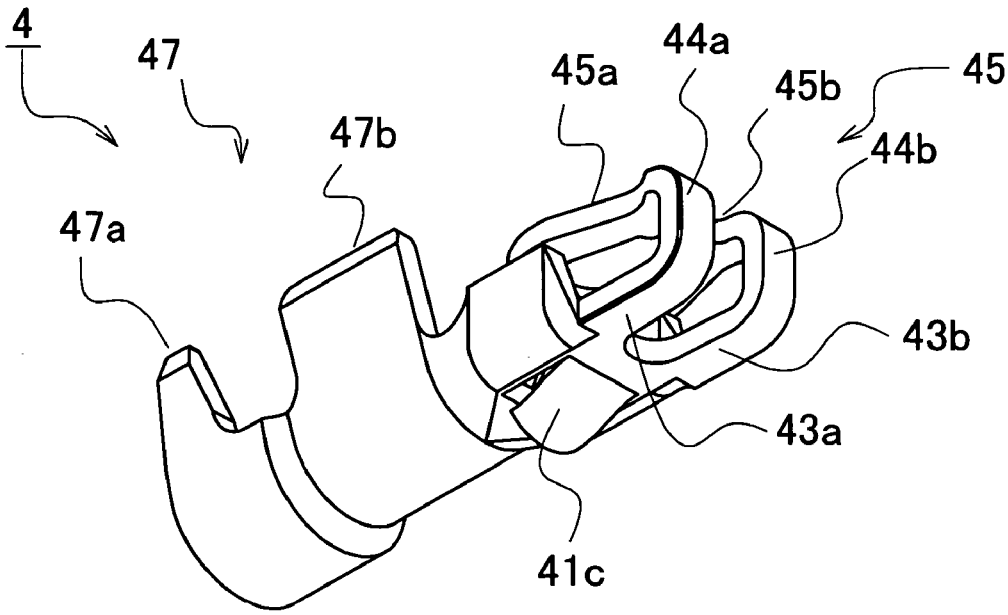
FIG. 8 is a perspective outline view of the opposing contact applied to the socket connector according to the embodiment.
Figure 9:
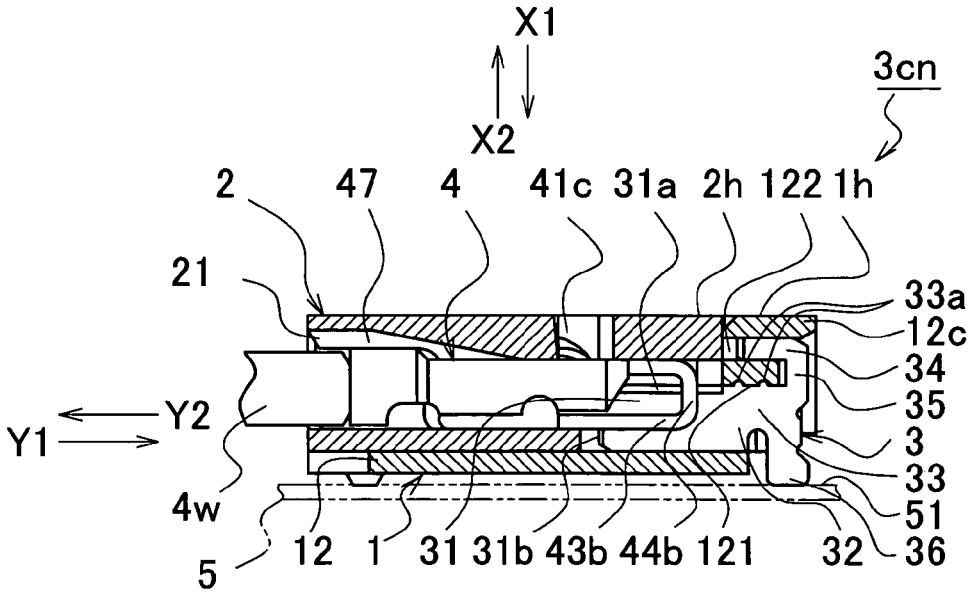
FIG. 9 is a longitudinal sectional view of both connectors in a connected state according to the embodiment.
Figure 10:
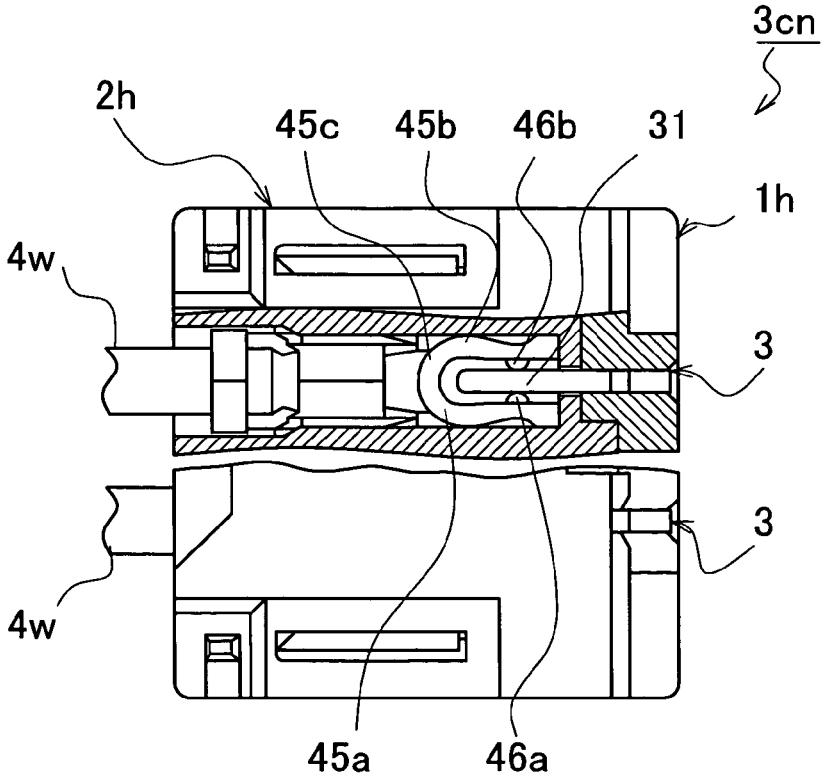
FIG. 10 is a plan view of both connectors in a connected-state according to the embodiment, the principal section thereof being a cross-sectional view.
Figure 11:
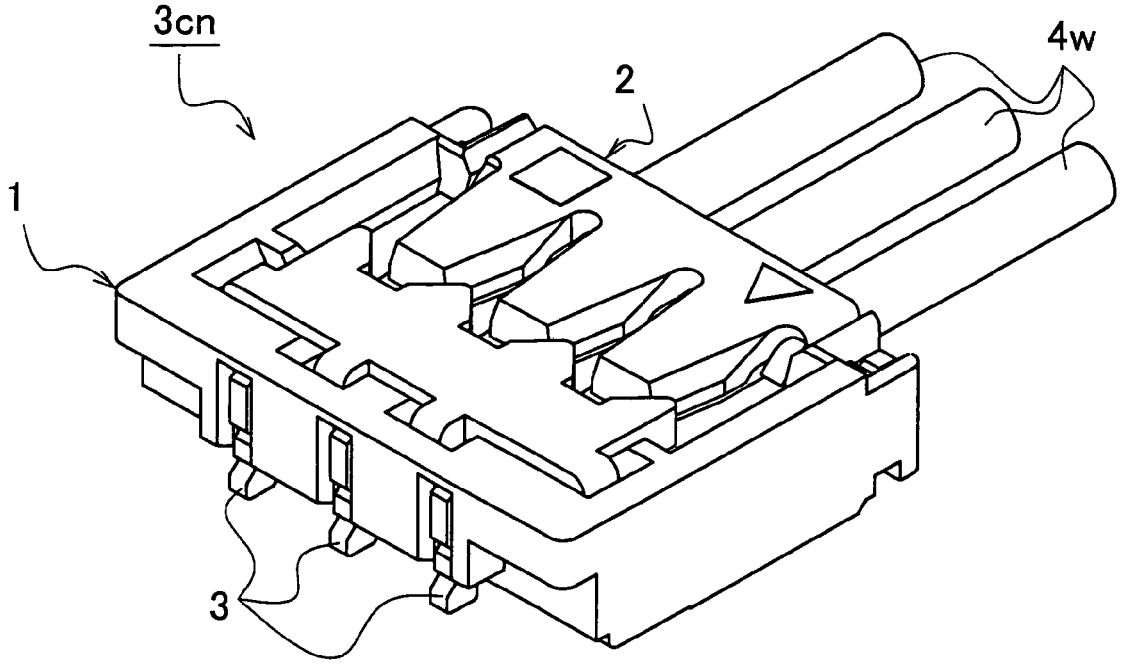
FIG. 11 is a perspective outline view of both connectors in a connected state according to the embodiment.
Figure 12:
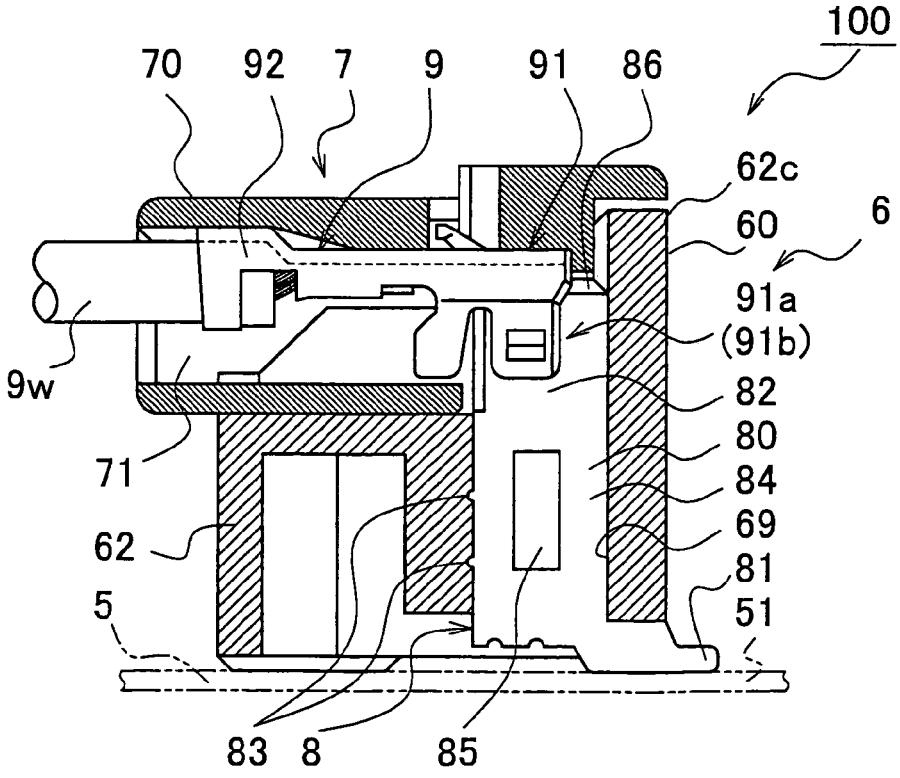
Fig. 12 PRIOR ART
FIG. 12 is a longitudinal sectional view of both connectors in a connected state according to the prior art.
Figure 13:
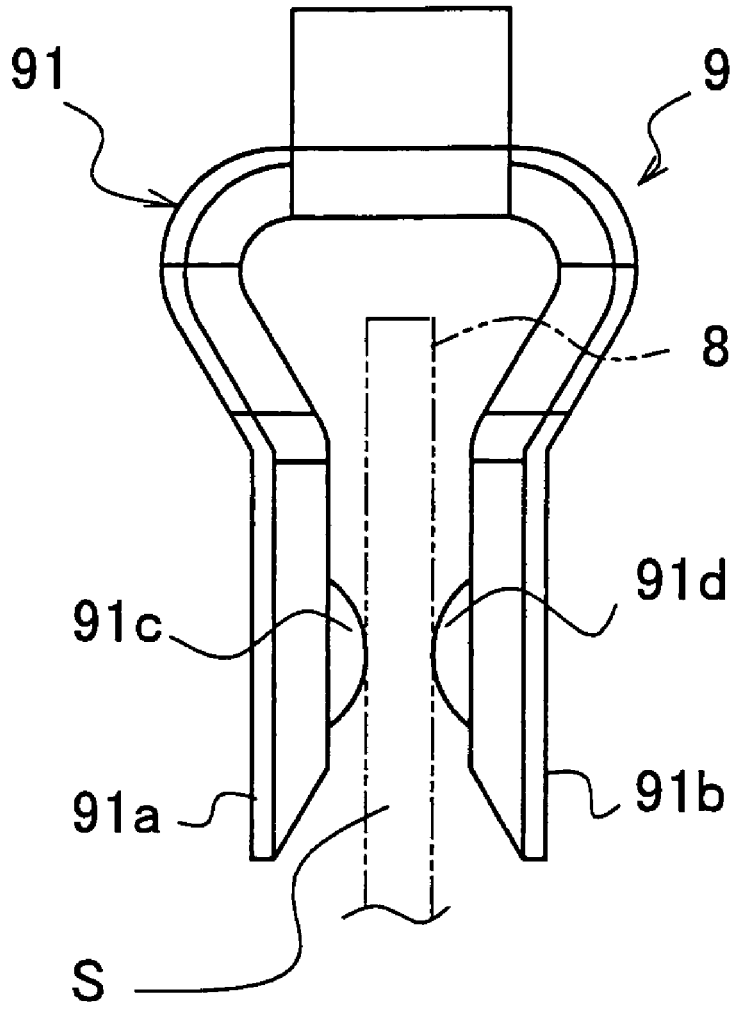
Fig. 13 PRIOR ART
FIG. 13 is a front view of a socket contact according to prior art.

FIG. 7 is a perspective outline view of the socket contact applied to the opposing connector according to the embodiment. FIG. 8 is a perspective outline view of the socket contact applied to the socket connector according to the embodiment. FIG. 8 shows the opposing contact from the side opposite of that in FIG. 7. FIG. 9 is a longitudinal sectional view of the base connector and the opposing connector in a connected state, showing a view in which the connector of FIG. 5 A is cut along a dashed line according to the embodiment. FIG. 10 is a plan view of the base connector and the opposing connector in a connected state according to the embodiment. In FIG. 10, principal sections are shown in a cross-sectional view. FIG. 11 is a perspective outline view of both connectors in a connected state according to the embodiment.

First, a base connector including a blade contact according to the embodiment of the present invention and an opposing connector which is connected to this base connector are explained. As shown in FIG. 1 and FIG. 2, a roughly rectangular base connector 1 is fixed to a mounting surface 51 of a printed circuit board 5 by solder bonding. The base connector has an elongated plate blade contact 3 and a roughly rectangular base housing 1*h* in which two side is open. The base housing 1*h* has a roughly square plate 12 (hereinafter called "base"). A pair of parallel opposing side walls 12*a* and 12*b* erect from the three sides of the base 12, and a back wall 12*c* is connecting ends of 12*a* and 12*b*. These walls 12*a*, 12*b*, 12*c* and the plate 12 forms a concave part11. The base housing is opened in the direction which is orthogonal to the mounting surface 51 of the printed circuit board 5 and in the direction which is facing away from the mounting surface 51 (equivalent to removal direction X2 in FIG. 1). In other words, a face opposing the base 12 is open. In addition, the base housing is opened in forward direction Y2, which is the parallel direction to the mounting surface 51, in other words, in a direction which a face opposing to the back wall.

The opposing connector 2 shown in FIG. 3 and FIG. 4 is inserted into and removed from the concave part 11 of base connector 1, along the insertion/removal directions X1 and X2 which are orthogonal to the mounting surface 51. The opposing connector 2 has a plurality of lead wires 4*w* which extend to the forward direction Y2.

When the opposing connector 2 is removed from the base connector 1, lead wire 4 may be pulled in an other direction than the removal direction X2. However, in this case, the pulling force via the lead wire 4*w* can be converted into a force for removal direction X2 of the opposing connector 2, and the opposing connector 2 can be pulled out smoothly without entangling.

As shown in FIG. 1 and FIG. 2, the base connector 1 includes a base housing 1*h*, and the base housing 1*h* has a base 12 which is fixed along the mounting surface 51, a pair of opposing side walls 12*a* and 12*b* erected on base 12, and a back wall 12*c* which is orthogonal to the opposing first side wall 12*a* and 12*b*. The concave part 11 is surrounded by three sides of the base 12, the pair of opposing side walls 12*a* and 12*b*, and the back wall 12*c*.

As shown in FIG. 1 and FIG. 2, three planar blade contacts 3 are arranged at the back wall 12*c* of the concave part 11, in parallel with the pair of opposing side walls 12*a* and 12*b*. As shown in FIG. 5, the blade contact 3 is held by the base 12 and second side wall 12*c* in a state that it is inserted and engaged to fixing holes 121 and 122 formed at the back wall 12*c*.

As shown in FIG. 9, the blade contact 3 includes a rectangular board-shaped contact connection part 31 for connecting to the opposing contact 4 and a fixing part 32 which is provided at the base end of the contact connection part 31 and is inserted and engaged within the back wall 12*c*. A bottom face extending in the longitudinal direction of the contact connection part 31 is in contact with the bottom surface of the concave part 11. The fixing part 32 extends the lead part 36, which is solder bonded to the printed circuit board 5, in the opposite direction of the contact connection part 31.

When both the base connector 1 and the opposing connector 2 are in the connected state shown in FIG. 9, a pair of reversed arms 45*a* and 45*b* provided in the socket contact 4 sandwich both surfaces of the sides of the contact connection part 31 and contact force is applied (refer to FIG. 10).

As shown in FIG. 1 and FIG. 2, a pair of fitting grooves 13*a* and 13*b* which extends from the bottom surface of concave part 11 to the perpendicular direction (that is in the removal direction X2) is provided on the internal face of the pair of first side walls 12*a* and 12*b*. The pair of fitting grooves 13*a* and 13*b* engage with a pair of projection pieces 23*a* and 23*b* (refer to FIG. 3 and FIG. 4) which are formed to protrude towards both wings of the opposing connector 2.

As shown in FIG. 3, FIG. 4, and FIG. 6, the lower corners of the pair of projection pieces 23*a* and 23*b* are arcuate and this arcuate surface forms a cam face which slides with a slope formed in the pair of fitting grooves 13*a* and 13*b* (refer to FIG. 5).

FIG. 1 and FIG. 2 shows that a pair of mutually opposing fitting concave part 16*a* and 16*b* is further provided on the pair of each opposing side walls 12*a* and 12*b* on the concave part 11. On the contrary, in socket housing 2*h*, a pair of fitting convex part 26*a* and 26*b* is provided on a pair of first outer walls formed in opposing positions (refer to FIG. 3, FIG. 4 and FIG. 6).

In addition, the connected state between both connectors 1 and 2 can be maintained by a predetermined holding force by the pair of fitting concave part 16*a* and 16*b* engaging with the pair of fitting convex part 26*a* and 26*b*. In this way, the pair of fitting concave part 16*a* and 16*b* and the pair of fitting convex part 26*a* and 26*b* configure a pair of first lock structure which engages together in the direction orthogonal to the direction the lead wire 4*w* is extended.

As shown in FIG. 1 and FIG. 2, the pair of fitting concave part 16*a* and 16*b* is formed in a shape, in which the lateral section of the pair of first inner walls has a C-shaped depression. The pair of depressions is formed, opposing each other, on the pair of inner opposing side walls. On the contrary, as shown in FIG. 3, FIG. 4 and FIG. 6, the pair of fitting convex part 26*a* and 26*b* is formed in a rough isosceles right triangle shape, in which the lateral section of the pair of first outer walls has a slope with an acute angle, and the pair of protrusion ends is formed in a mutually opposing direction on the pair of first outer walls.

By providing the pair of fitting concave part 16*a* and 16*b* on the pair of first inner opposing side walls of the base housing 1*h*, a thickness of the pair of opposing side walls 12*a* and 12*b* which divide the concave part 11 becomes thin, and an easy insertion/removal of the socket connector 2 is facilitated. In addition, by providing the pair of fitting concave part 16*a* and 16*b* to the pair of inner opposing side walls of the base housing 1*h*, base housing 1*h* can be miniaturized (reduction in mounting area).

In addition, as shown in FIG. 1 and FIG. 2, in the concave part 11 in base housing 1*h*, two grooves 14*a* and 14*b* are provided on a internal back wall (included in back wall 12*c*) formed in direction Y1, which is an opposite direction in which lead wire 4*w* extends. The two grooves 14*a* and 14*b* are open to the concave part 11, and in addition, penetrate along the insertion/removal direction X1 and X2 which are orthogonal to the mounting surface 51 of printed circuit board 5. In addition, the two grooves 14*a* and 14*b* are provided respectively among the arrays of blade contacts 3. Furthermore, first protrusions 15*a* and 15*b* are provided on each internal wall oriented orthogonally with these grooves 14*a* and 14*b*, respectively (refer to FIG. 1 and FIG. 5).

On the other hand, as shown in FIG. 3 and FIG. 4, in opposing housing 2*h*, two convex pieces 24*a* and 24*b* are provided on a second outer wall formed in direction Y1, which is the opposite direction in which lead wire 4*w* extends (refer to FIG. 1). In addition, second protrusions 25*a* and 25*b* are provided on one outer wall of these convex pieces 24*a* and 24*b*.

When the opposing connector 2 is inserted towards the concave part 11, two convex pieces 24*a* and 24*b* are inserted into two grooves 14*a* and 14*b*, and second protrusion 25*a* and 25*b* go over first protrusions 15*a* and 15*b*, respectively. When the opposing connector 2 is completely inserted into the concave part 11, the second protrusions 25*a* and 25*b* are engaged with the first protrusions 15*a* and 15*b*, and the locked state of the socket connector 2 and the base connector 1 is maintained (refer to FIG. 11)

In this way, the two grooves 14*a* and 14*b* and the two convex pieces 24*a* and 24*b* configure one or more second lock structure in which they are mutually engaged. First protrusions 15*a* and 15*b* and second protrusions 25*a* and 25*b* are included in the second lock structure. In addition, the two grooves 14*a* and 14*b* are illustrated as square grooves, however, they can be U-shaped arcuate grooves, as well.

As shown in FIG. 1 and FIG. 2, a pair of projection parts 18*a* and 18*b* which face each other is provided on a pair of internal wall of 12*a* and 12*b* in the concave part 11. One projection part 18*a* divides a fitting groove 13*a* and a fitting concave part 16*a*. In addition, one projection part 18*a* is inserted between projection piece 23*a* and fitting convex part 26*a*. The other projection part 18*b* divides the fitting groove 13*b* and the fitting concave part 16*b*. In addition, the other projection part 18*b* is inserted between projection piece 23*b* and fitting convex part 26*b*.

As shown in FIG. 1, FIG. 2, and FIG. 5, the pair of reinforcement tabs 17*a* and 17*b*, made of a metallic reinforcement component, is pressed to the pressing groove formed on the front lower part of the base housing 1*h*. A part thereof is exposed to the bottom surface of the base housing 1*h*, and it is solder bonded to the mounting surface 51 of the printed circuit board 5.

In FIG. 6, the front part of the opposing connector 2 includes a convex part 22*c* which protrudes, in correspondence to the position of blade contacts 3, to an upper face which acts as the pressing face of an opposing housing 2*h*, and the pair of projection pieces 23*a* and 23*b* which protrude, respectively, towards both side surfaces of the opposing housing 2*h*. By pressing the front surface of convex part 22*c*, the opposing connector 2 can be attached to the base connector 1.

In FIG. 3 and FIG. 4, the opposing connector 2 has a rectangular opposing housing 2*h*. A reception hole 21 is provided in opposing housing 2*h*, in the direction in which the lead wire 4*w* is ex holes 21 are aligned and provided in the opposing housing 2*h*. Each reception hole 21 accommodates a socket contact 4 which is crimped to the end of the lead wire 4*w*, respectively (refer to FIG. 9).

The socket contact 4, shown in FIG. 7 and FIG. 8, is connected to blade contact 3. The socket contact 4 includes an elongated crimp part 47 to which lead wire 4*w* is connected and a contact connection part 45 which is provided on the base end of the crimp part 47 and connected to blade contact 3.

The contact connection part 45 includes a planar contact body 41, a pair of extending arms 43*a* and 43*b* which are almost parallel and extends from the base end 42 of the contact body 41, and a pair of reversed arms 45*a* and 45*b* which are almost parallel and extends from the tips of the pair of extended arms 43*a* and 43*b* to the contact body 41, the tips of which are mutually joined. The pair of reversed arms 45*a* and 45*b* are provided with a pair of contact points 46*a* and 46*b* which are mutually opposed and into which blade contact 3 can be inserted.

As shown in FIG. 7 and FIG. 8, the tips of the pair of reverse arms 45*a* and 45*b* are mutually joined. The tips of the pair of reversed arms 45*a* and 45*b* are mutually joined in advance, a connection part 45*c* is formed, and the pair of reversed arms 45*a* and 45*b* is formed by a folding processing.

As shown in FIG. 7 and FIG. 8, a pair of contact points 46*a* and 46*b* which are mutually opposing semispherical protrusions is formed on the thickness faces of the folded-back part 44*a* and 44*b* of the pair of reversed arms 45*a* and 45*b*. The planar blade contact 3 (refer to FIG. 9) can be inserted between this pair of contact points 46*a* and 46*b*. The contact connection part 31 is inserted between the pair of contact points 46*a* and 46*b*, from the pair of reverse arms 45*a* and 45*b* to the pair of extended arms 43*a* and 43*b* (refer to FIG. 9 and FIG. 10).

When the contact connection part 31 is inserted between the pair of contact points 46*a* and 46*b*, the pair of contact points 46*a* and 46*b* are pressed apart. Namely, the folded-back part 44*a* and 44*b* of the pair of extended arms 43*a* and 43*b* and the pair of reversed arms 45*a* and 45*b* are pressed apart. Because the pair of extended arms 43*a* and 43*b*, the pair of reversed arms 45*a* and 45*b*, the folded-back part 44*a* and 44*b* and the opposing sides thereof are mutually joined, an appropriate contact force can be applied to both surfaces of the contact connection part 31 by elastic force.

This socket contact 4 can apply a stronger contact force to the blade contact 3, compared to that of the conventional socket contact, and furthermore, can be made smaller than the conventional socket contact. In addition, the socket contact 4 can be placed in parallel in a narrow pitch of about 1.2 mm. The opposing connector 2 to which such socket contact 4 is applied can be reduced in height and miniaturized.

As shown in FIG. 7 and FIG. 8, a crimp part 47 for crimping the lead wire 4*w* is provided in the socket contact 4. In addition, the crimp part 47 includes an insulation grip 47*a* which is crimped to the covering part of the lead wire 4*w* and a conductor grip 47*b* which is crimped to the core of the lead wire 4*w*. One terminal of the lead wire 4*w* is crimped and inserted into the reception hole 21 (refer to FIG. 9)

In FIG. 9, a lance 41*c*, which is formed from an elastic protrusion, is communicated through the reception hole 21 and engaged to an engaging hole which is opened on the outer surface. The socket contact 4 prevents the lance 41*c* from slipping out of the reception hole 21. In the opposing connector 2, the part in which the pair of contact points 46*a* and 46*b* faces to the base connector 1 is opened, and the blade contact 3 can be inserted into the pair of contact points 46*a* and 46*b* (refer to FIG. 10).

In FIG. 9, the blade contact 3 includes a rectangular contact connection part 31 and a fixing part 32 which is provided on the base end of contact connection part 31. Fixing part 32 is held within the second side wall 12*c* in a state in which it is inserted into and engaged with fixing holes 121 and 122 (refer to FIG. 5), formed in the second side wall 12*c*. In addition, the fixing part 32 includes a pressing part 33 which is pressed into the second side wall 12*c*, a fixing arm 34 which is associated from the pressing part 33 and is also inserted into the second side wall 12*c*, and a connecting leg 35 which connects the base ends of the pressing part 33 and the fixing arm 34 together.

A shown in FIG. 9, the pressing part 33 is held within the second side wall 12*c* in a state in which it is pressed to the fixing hole 122 formed in the second side wall 12*c* (refer to FIG. 5). The fixing arm 34 is held within the second side wall 12*c* in a state in which it is inserted into the fixing hole 122 formed in the second side wall 12*c* (refer to FIG. 5). In addition, connecting leg 35 is inserted into a slit-shaped groove which communicates the fixing hole 121 and the fixing hole 122.

As shown in FIG. 9, because the fixing part 32 of the blade contact 3 is configured as above, when the opposing contacts are inserted into the contact connection parts 31 of the blade contacts 3, a torque of an inserting direction, of which a fulcrum is the pressing part 33, the contact connection part 31 is connected to the bottom surface of the concave part 11 (refer to FIG. 1) and the position of the blade contacts 3 are maintained. On the other hand, when the opposing contact is removed from the contact connection parts 31 of the blade contact 3, the torque of a removal direction, of which the fulcrum is the pressing part 33, is obstructed by the fixing arm 34 and the position of the blade contacts 3 are maintained.

In addition, the pressing part 33 includes a pressing protrusion 33*a* which is engaged within the back wall 12*c* on the side facing the fixing arm 34. The pressing protrusion 33*a* can be a fine protrusion which protrudes in a mountainous state and can be pressed such as to chumble the internal back wall which is formed of synthetic resin. In addition, the position of the blade contacts 3 are maintained firmly by mutually associated fixing arm 34 and pressing part 33 sandwiching the internal back wall 12*c*.

As shown in FIG. 9, a chamfer is formed on the upper edge 31*a* and front edge 31*b* of the contact connection part 31, facilitating the easy insertion of socket contact 4. In addition, a bottom surface extending in the longitudinal direction of the contact connection part 31 is in contact with the bottom surface of the concave part 11.

According to the present invention, the connector includes a base connector which forms a concave part with a pair of opposing side walls and a back wall which is orthogonal to this pair of opposing side walls, and the blade contacts are inserted towards and engaged with the concave part from the inside of the back wall, and the contact connection part for connecting to the opposing contact is in contact with the bottom surface of the concave part. Therefore, the position of the blade contact can be maintained by the bottom surface of the concave part and the back wall more firmly and easy, comparing the conventional way of the maintaining the position of the blade contacts through pressing the blade contacts from the bottom surface of the base. Thus, the thickness of the base can be made thin and further lowering of the height of the base connector can be realized. For example, the height of the base connector can be reduced from the conventional "6.1" mm to "1.5" mm.

The base connector 1 includes the blade contacts 3 according to the present invention. The connector 3*cn* is connected with the opposing connector 2 including the socket contact 4 (refer to FIG. 11). The base connector and the connector 3*cn* are extremely miniaturized and low in height, and are suitable for modern miniaturized mobile electronic devices.

What is claimed is:

1. A base connector comprising:

a housing having a rectangular plate bottom board, a back wall, and a pair of opposing side walls which are perpendicular to the bottom board, the back wall and the pair of opposing side walls protruding from three edges of the bottom board; and a blade contact which is an elongated plate extends parallel to the side wall, the blade contact comprising:

a fixing part at an end of the blade contact, the fixing part being embedded in the back wall; and a bottom face in contact with a surface of the rectangular plate bottom board, wherein the fixing part comprises a pressing part extending from a contact connection part which is pressed into the back wall, a fixing arm which opposes this pressing part and is inserted into the back wall, and a connecting leg for connecting the base-ends of the pressing part and the fixing arms together.

2. A base connector according to claim 1, wherein the pressing part comprises a pressing protrusion for being engaged within the back wall on the side facing the fixing arm.

3. A base connector according to claim 1, wherein the fixing part extends a lead part which is solder bonded to a printed-circuit board in the opposite direction of the contact connection part.

4. A base connector according to claim 1, wherein the fixing part extends a lead part which is solder bonded to a printed-circuit board in the opposite direction of the contact connection part.

5. A base connector according to claim 2, wherein the fixing part extends a lead part which is solder bonded to a printed-circuit board in the opposite direction of the contact connection part.

6. A base connector according to claim 1, wherein the fixing part further comprises a fixing hole for inserting the fixing arm, the fixing hole being provided from the back wall toward the inside of the housing, extending parallel to the bottom board.

* * * * *